United States Patent [19]

Kaminski

[11] Patent Number: 4,863,333

[45] Date of Patent: Sep. 5, 1989

[54] APPARATUS FOR FORMING CANS

[75] Inventor: Elton G. Kaminski, Sidney, Ohio

[73] Assignee: The Stolle Corporation, Sidney, Ohio

[21] Appl. No.: 62,117

[22] Filed: Jun. 12, 1987

[51] Int. Cl.[4] ..... B21D 51/28

[52] U.S. Cl. ..... 413/69; 72/349; 72/405; 72/347

[58] Field of Search ..... 413/69; 72/347, 348, 72/349, 339, 332, 405

[56] References Cited

U.S. PATENT DOCUMENTS

| | | | |
|---|---|---|---|
| 2,012,423 | 8/1935 | Ferris | 72/349 |
| 3,941,070 | 5/1976 | Kaminski | 72/349 |
| 4,007,621 | 2/1977 | Franek et al. | 72/347 |
| 4,416,140 | 11/1983 | Bolso, Jr. et al. | 72/347 |

*Primary Examiner*—Frederick R. Schmidt
*Assistant Examiner*—Robert Showalter
*Attorney, Agent, or Firm*—Frost & Jacobs

[57] ABSTRACT

A press for forming cans from a metallic sheet includes a first work station having a blanking and drawing punch for cutting a blank from the sheet and drawing a cup from the blank. A second work station includes a redrawing punch for redrawing the cup to a smaller diameter to form a can. The redrawing punch travels through an opening formed in the sheet when the blank is cut from the sheet and acts in concert with the blanking and drawing punch. When the redrawing operation is complete, the redrawing punch reciprocates out of the opening in the sheet, as does the blanking and drawing punch, so that the sheet can advance to the next station. Other subsequent work stations act in concert with the blanking and drawing punch and redrawing punch by passing through openings formed in the sheet when a blank is punched at the first work station.

3 Claims, 4 Drawing Sheets

APPARATUS FOR FORMING CANS

BACKGROUND OF THE INVENTION

1. Field of the Invention

The present invention relates generally to a press for manufacturing cans. In particular, the press receives a metallic coil strip or sheet (generally aluminum or steel) and includes a plurality of work stations wherein subsequent tooling for forming a can passes through openings in the metallic sheet formed at the first work station when a blank is punched.

2. Description of the Related Art

Drawn and redrawn cans for containing food and the like are well known. Cans of the two-piece variety are becoming more prevalent since they provide better integrity and less potential for leaks than three-piece cans. The two-piece can includes a bottom and side wall formed as one piece and a top, as contrasted to the three-piece can which includes separate top, bottom and side wall components.

Presses for forming cans are well known in the art. In general, a metallic coil strip or sheet is provided in a desired width. Wide width coil sheets offer economical metal use since slitting of the coil at the mill is elminated and process scrap during manufacture of the can is minimized. Oftentimes, the metallic sheet is precoated with lacquers or enamels when used for cans of the shellow draw variety. For cans of the deep draw variety, the metallic sheet is left uncoated since such cans are coated with lacquers or enamels after the can is formed.

In conventional can manufacturing systems, a plurality of work stations are provided and often include the following steps: blanking, cupping, redrawing, trimming the flange/beading, cleaning, coating, curing and testing. The cup is first blanked and drawn from a coated metallic sheet. The cup is then transferred to separate stations and equipment for selected operations. In some conventional systems only coils or sheets of limited widths can be utilized.

It is known in the art to provide a single work station for blanking, drawing and redrawing a can. Other known systems perform blanking, drawing and reverse redrawing in a single station. These multi-use stations, although functional, are difficult to maintain. If a cup or redrawn cup breaks during the forming process, the downtime for cleaning the tooling of fractured cups and metal scraps is difficult and time consuming, thereby reducing efficiencies. The use of wide width coils dictates a multiplicity of multi-use tooling stations wherein breakouts are likely to occur.

Capital equipment requirements in presses can be minimized if a press can accept coils of various widths and if the press can perform more than one operation.

Consequently, a need exists for improvements in presses for forming cans from metallic stock. It is desirable that such presses accept various widths of metallic stock, particularly wide widths. Furthermore, it is desirable that such a press be capable of performing more than one operation during the formation of a can. The multiple-operation press should include work stations which are separate from one another, but which are operable without having to transfer a can to a separate apparatus.

SUMMARY OF THE INVENTION

The present invention includes a press for forming cans from a metallic sheet or coil. A first work station includes a blanking and drawing punch for cutting a blank from the sheet and drawing a cup from the blank. A second work station includes a redrawing punch for redrawing the cup to a smaller diameter to form a can. The redrawing punch travels through an opening formed in the sheet when the blank is cut from the sheet and acts in concert with the blanking and drawing punch. When the redrawing operation is complete, the redrawing punch reciprocates out of the opening in the sheet, as does the blanking and drawing punch, so that the sheet can advance to the next station.

In accordance with other aspects of the invention, subsequent work stations can be provided for performing various tooling functions. For example, a third work station can include a trimming punch for trimming a can as desired. The trimming punch enters an opening formed in the sheet when the blank is cut in the first work station and acts in concert with the blanking and drawing and redrawing punch.

BRIEF DESCRIPTION OF THE DRAWINGS

Other features and advantages of the present invention will become more fully apparent from the following detailed description of the preferred embodiment, the appended claims and the accompanying drawings in which:

Reference will now be made in detail to the present preferred embodiment of the invention, an example of which is illustrated in the accompanying drawings.

DETAILED DESCRIPTION OF THE PREFERRED EMBOIDMENTS

Figure 1:
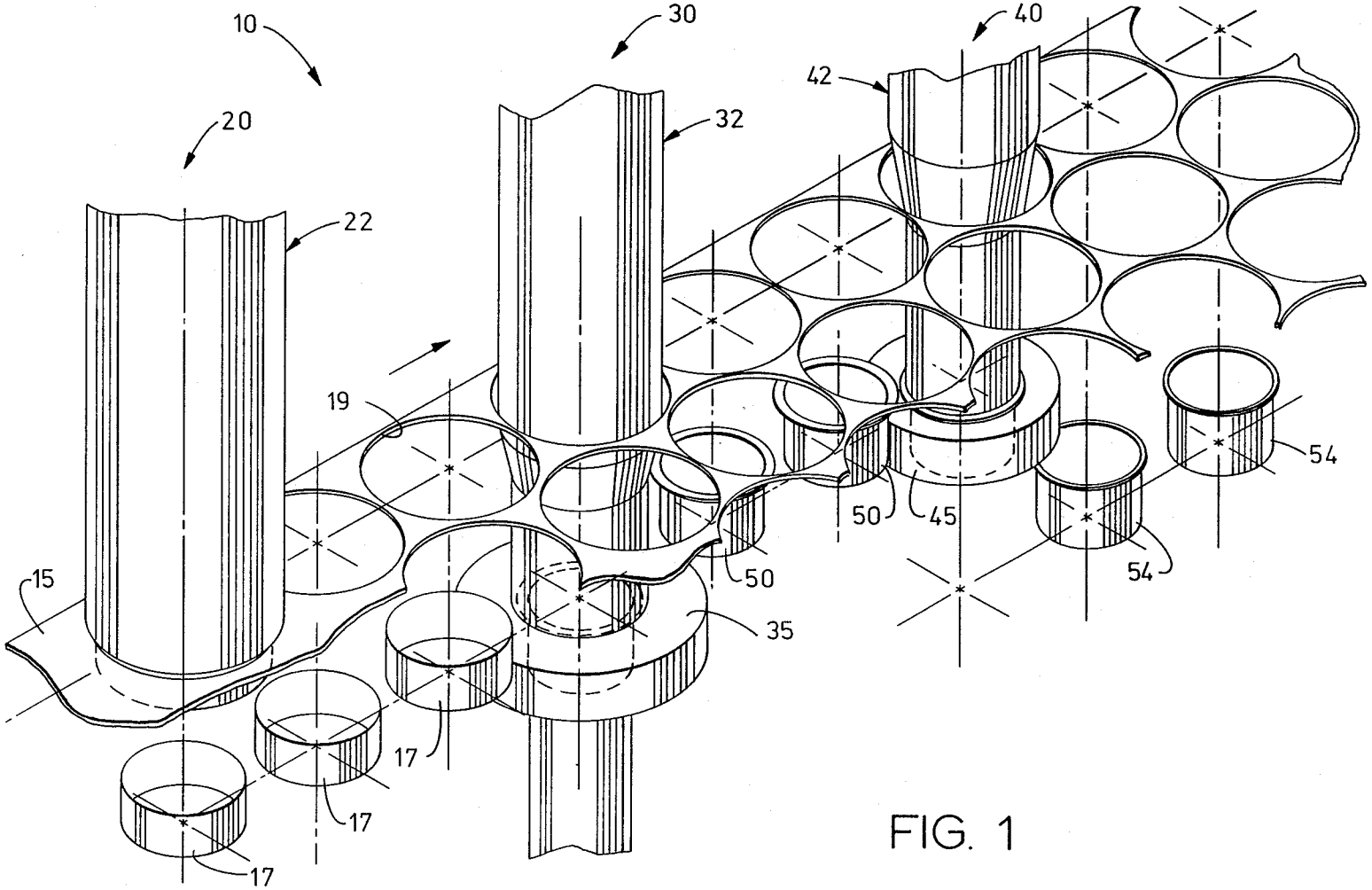
FIG. 1 is a partial, perspective view of the press of the present invention illustrating an metallic sheet or coil being fed to first, second and third work stations.
Figure 2A:
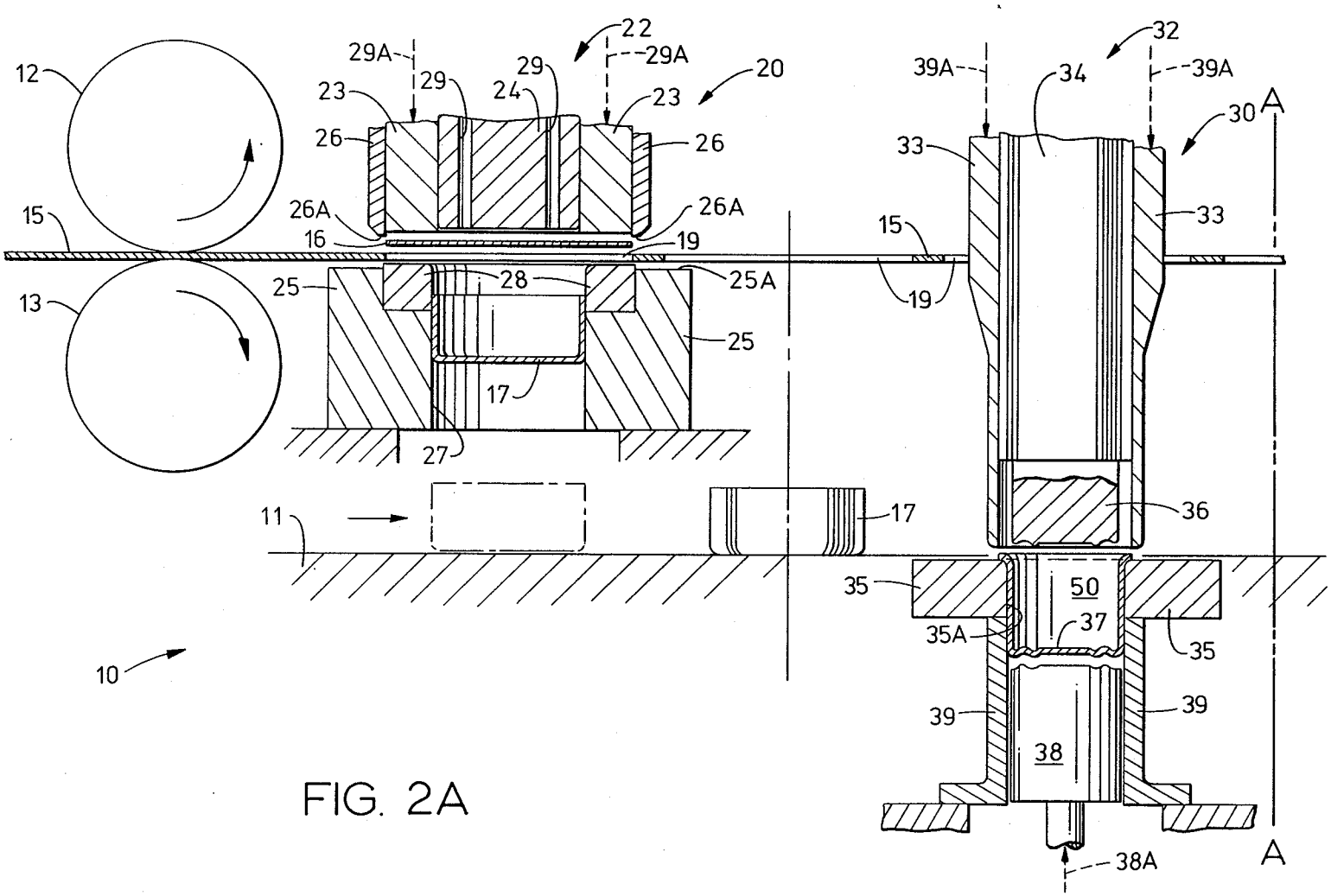
FIG. 2A is a side elevational view of the press of FIG. 1 illustrating the first and second work stations.
Figure 2B:
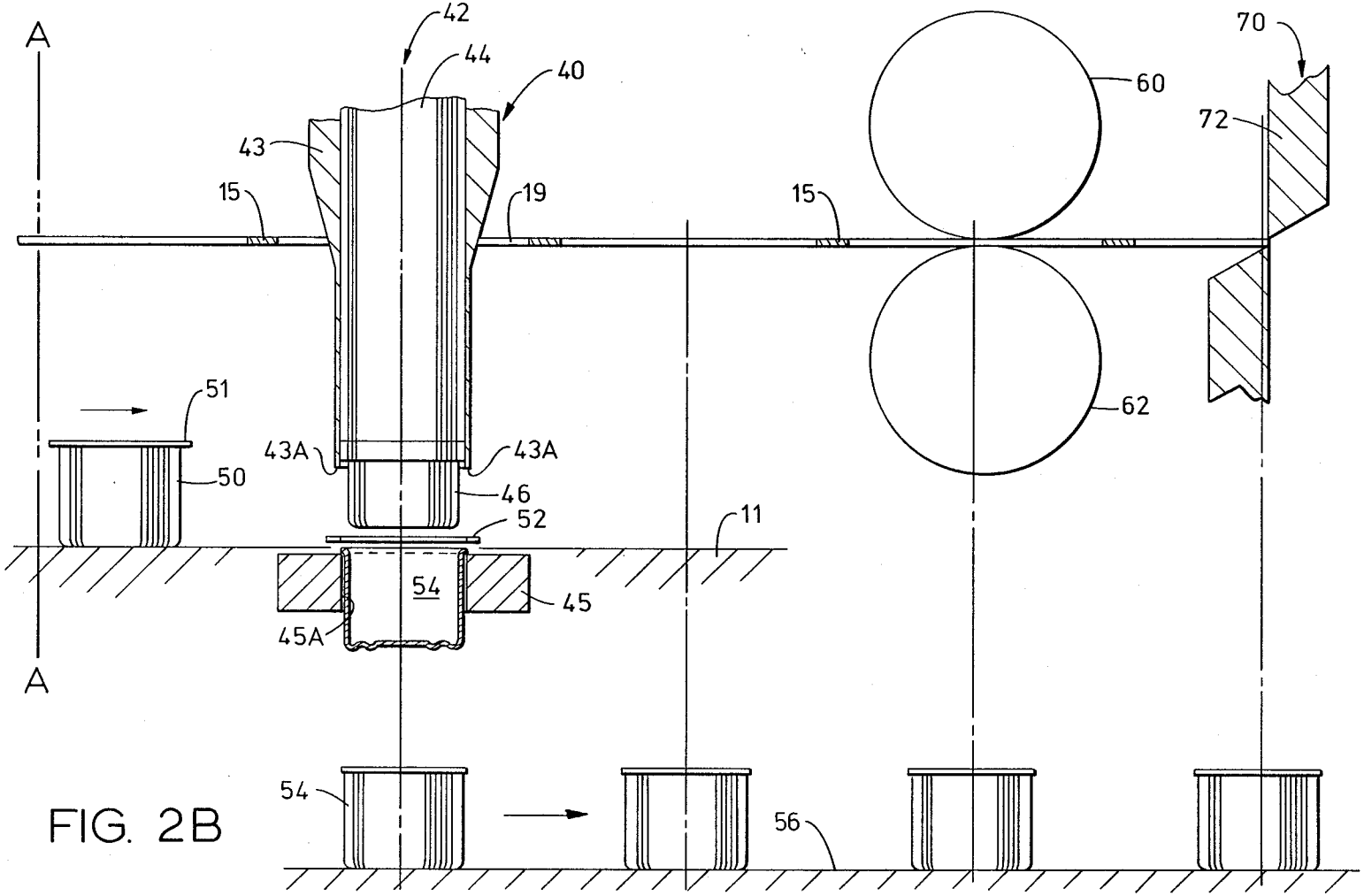
FIG. 2B is a continuation of the side elevational view of FIG. 2A illustrating the third work station.

A press of the present invention, indicated generally at 10, is illustrated in FIGS. 1, 2A and 2B.

A pair of rollers 12 and 13 driven by conventional intermittent drives feeds a metallic coil or 15 to a first work station, indicated generally at 20. The first work station 20 includes a drawing punch assembly 22 having an outer pressure pad 23, a drawing punch 24 and a blanking and drawing die 25. A cutter 26 terminating in a cutting edge 26A is secured to the lower portion of the pressure pad 23. The die 25 includes a central opening 27 for receiving the drawing punch 24. The die 25 includes an annular die-piece 28 around the upper portion of the opening 27 and protrudes slightly above the upper surface 25A of the die 25.

As the sheet 15 is delivered to the first work station 20 between the blanking and drawing punch assembly 22 and the die 25, the punch assembly 22 travels downwardly to the die 25. As the pressure pad 23 contacts the sheet 15, the cutting edge 26A cooperates with the die-piece 28 to cut a circular blank 16 from the sheet 15.

An opening 19 remains in the sheet 15 where the blank 16 was punched.

Next, the drawing punch 24 is extended downwardly into the opening 27 to draw the blank 16 and form a cup 17. During the drawing process, pressure is maintained on blank 16 between the pressure pad 23 and the diepiece 28 to prevent wrinkling of the cup 17. Conventional means, e.g. air pressure exerted on pressure pad 23 indicated at arrows 29A, can be employed to prevent wrinkling.

After the cup 17 is formed, the drawing punch 24 is retracted back into the pressure pad 23 and the drawing punch assembly 22 is moved upwardly to a position above the plane of the sheet 15. At this point, the metallic sheet 15 can be advanced so that the next blank 16 can be punched from the sheet 15.

If desired, air ports 29 can be provided in the drawing punch 24 and connected to a source of air. At the bottom of the drawing stroke, air can be injected through the ports 29 to enhance separation of a cup 17 from the drawing punch 24.

After a cup 17 is formed, it drops through the opening 27 to a platform 11 located beneath the plane of the metal sheet 15. The cup 17 travels to a second work station, indicated generally at 30, for redrawing. It is preferred that the cup 17 be moved along the platform 11 by pressurized air. One such aerodynamic transfer system is disclosed in U.S. Pat. No. Re. 29,645, issued to the present inventor in 1978, which is hereby incorporated by reference. However, it is understood that other conveyor systems can be utilized to transfer the cup 17 to subsequent work stations.

The second work station 30 includes a redrawing punch assembly 32, having a pressure sleeve 33, an inner punch 34 and a redrawing die 35. As illustrated in FIG. 2A, the lower end of the punch 34 can include tooling 36 for forming a step bottom in a can 50. The step bottom 37 provides better pressure resistance as well as stackability for cans 50. The die 35 includes an opening 35A for receiving a cup 17. After a cup 17 is seated in opening 35A, the drawing punch assembly 32 travels downwardly through an opening 19 and punch 34 is extended so that tooling 36 enters and redraws a cup 17 into a can 50. Tooling 36 are sized to fit snugly into cup 17. Pressure sleeve 33 exerts pressure on the cup 17 against the upper surface of redraw die 35 to prevent wrinkling during the redrawing process. Conventional means, e.g. air pressure, exerted on pressure sleeve 33 indicated at arrows 39A, can be employed to prevent wrinkling. After the can 50 is formed, the redrawing punch assembly 32 is retracted to a position above the plane of the sheet 15.

The second work station 30 can include a lift-out plunger 38 which cooperates with the punch 34 of the second work station 30. A housing 39 for the plunger 38 is connected to the die 35 opposite the redrawing punch assembly 32. At the bottom of the redrawing stroke, the punch 34 meets the plunger 38 and forms the step bottom 37 in the can 50. As the redrawing punch assembly 32 is retracted upwardly to a position above the opening 19 in the 15, the lift-out plunger 38 travels upwardly until the can 50 clears the opening 35A and is transferred to the platform 11. Then the plunger 38 is maintained in the upward position in the housing 39 and readied for the next cup 17. Air pressure springs, or other means indicated at 38A are utilized to maintain plunger 38 in the upward position.

As illustrated in FIG. 2B, cans 50 exiting the second work station 30 include a flange 51. The cans 50 can travel to a third work station, indicated generally at 40 for trimming. The third work station 40 includes a trimming punch assembly 42, having an outer sleeve 43, a locating punch 44, and a trimming die 45. An extension 46, designed to fit inside a can 50, is provided at the lower portion of locating punch 44. The lower portion of the outer sleeve 43 terminates in a cutting edge 43A.

As the can 50 travels to the third work station 40, the trimming punch assembly 42 is retracted above the plane of the sheet 15. The can 50 travels along the platform 11 and seats into an opening 45A in the trimming die 45. When the can 50 is seated, the trimming punch assembly 42 travels downwardly through an opening 19 in the sheet 15 until the outer sleeve 43 contacts the flange 51 of a can 50 and the extension 46 fits into the can 50. The cutting edge 43A removes scrap 52 from the flange 51 of the can 50.

As the trimming punch assembly 42 is retracted upwardly above the plane of the sheet 15, the trimmed can 54 falls through opening 45A onto a platform 56 provided beneath platform 11. It is preferred that air be used to transport the trimmed cans 54 along platform 56 to a selected location. Of course, other conveyor means can be utilized to transport the formed cans 50 to selected stations.

As illustrated in FIG. 2B, rollers 60 and 62 driven by conventional intermittent drives feed the punched sheet 15 to a scrap station 70. The scrap station 70 includes cutters 72 which chop the punched sheet 15 into scrap material. The scrap material can be recycled as desired.

Figure 3:
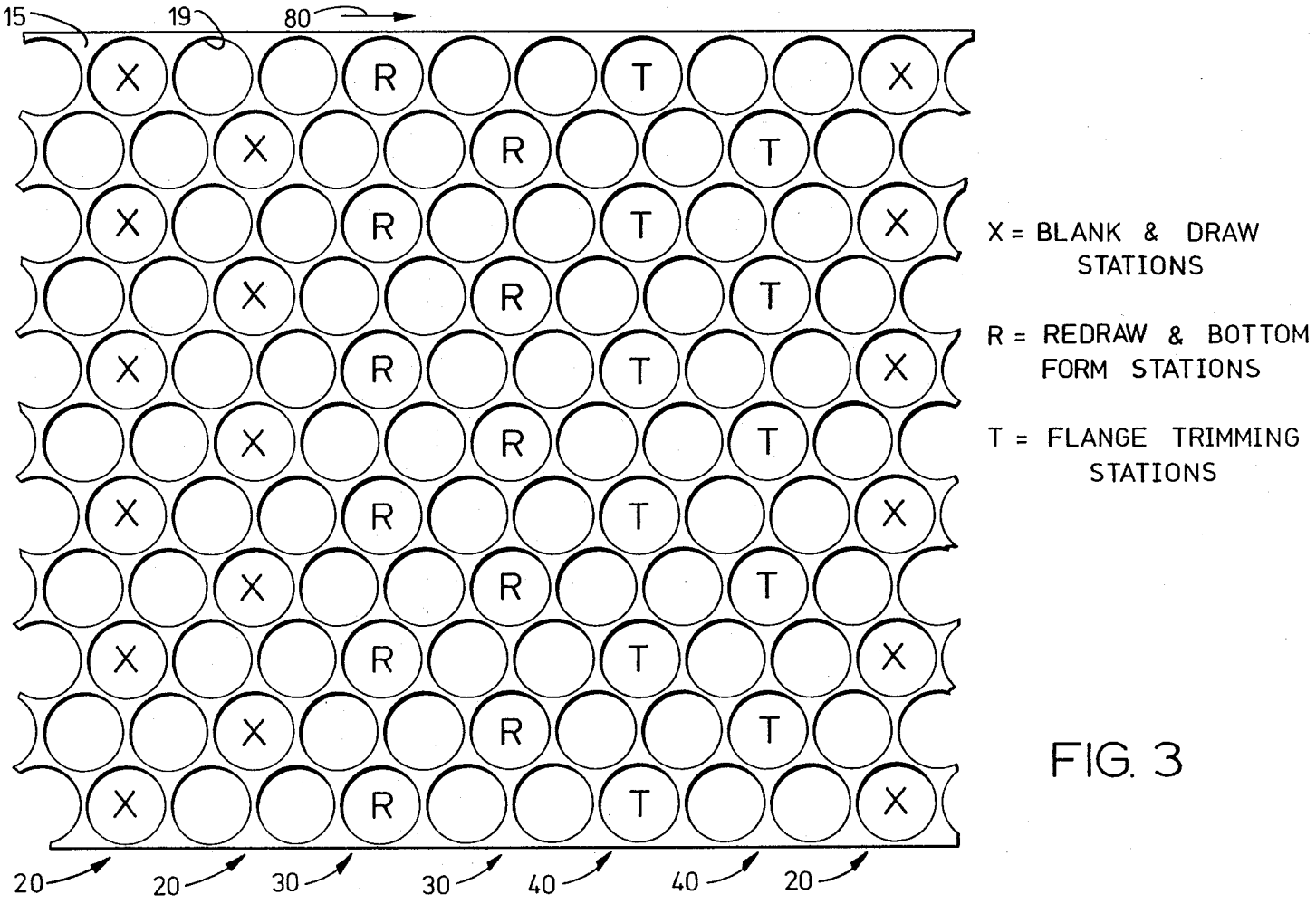
FIG. 3 is top plan view of a preferred cutting pattern of a metallic sheet utilized with the present press wherein the locations of first, second and third work stations have been indicated.

FIG. 3 illustrates a typical cutting pattern for sheet 15 used with the press 10 of the present invention. The sheet 15 is fed into the press 10 from left to right in FIG. 3, as illustrated by arrow 80. The locations of the first, second and third work stations (20, 30 and 40, respectively) have been indicated. In the pattern illustrated in FIG. 3, eleven blanks 16 are stamped from the width of the sheet 15. It is preferred that subsequent work stations be staggered at selected intervals in the pattern.

As illustrated best in FIG. 1, a preferred mode of operation includes simultaneous action at the first, second and third work stations (20, 30 and 40, respectively). As the blanking and drawing punch assembly 22 stamps a blank 16 from the sheet 15 and performs the first drawing operation, the redrawing punch assembly 32 and trimming punch assembly 42 pass through openings 19 downstream of the first work station 20 and perform their respective functions. Once the operations are complete, assemblies 22, 32 and 42 are retracted above the plane of travel of the sheet 15 so that rollers 12, 13, 60 and 62 can advance the sheet 15 for the next operation.

In certain applications, only two work stations may be needed for can formation. For example, to produce a non-trimmed can 50, only the first work station 20 and the second work station 30 are required. After a can 50 has been redrawn at the second work station 30, the can 50 can be discharged from the press 10 to other equipment for trimming and/or any other desired functions. In another example, two work stations could be provided to form a redrawn can without a flange. The can 50 would be discharged through the opening 35A in the die 35 of the second work station 30 as the redrawing punch assembly 32 is retracted. In such an application, a lift-out plunger 38 would not be employed. Other variations of the press 10 wherein subsequent work stations include punches and tooling which pass through openings 19 in the sheet 15 for forming a can are within the scope of the present invention.

Although the present invention has been described with reference to preferred embodiments, workers skilled in the art will recognize that changes may be made in form and detail without departing from the spirit and scope of the invention.

What is claimed is:

1. A press for forming cans from a metallic sheet comprising:

(a) a first work station having a blanking and drawing punch for cutting a blank from the metallic sheet and drawing a cup from the blank;

(b) a second work station having a redrawing punch for drawing the cup to a smaller diameter to form a can while the cup is disposed entirely below the metallic sheet, wherein the redrawing punch passes through an opening in the metallic sheet formed during cutting at the first work station, the second work station including a lift-out plunger which cooperates with the redrawing punch at the bottom of the redraw stroke to form a step in the can;

(c) a third work station having a trimming punch for trimming the can while the can is disposed entirely below the metallic sheet, wherein the trimming punch passes through an opening in the metallic sheet formed during the cutting at the first work station; and (d) means for injection air through the drawing punch to facilitate stripping of the cup from the drawing punch after drawing is complete.

2. The apparatus as specified in claim 1 including conveyor means for transferring the can from one work station to a subsequent work station.

3. The apparatus as specified in claim 2 wherein the conveyor means comprises an aerodynamic transfer system.

* * * * *

UNITED STATES PATENT AND TRADEMARK OFFICE

CERTIFICATE OF CORRECTION

PATENT NO. : 4,863,333

DATED : September 5, 1989

INVENTOR(S) : Elton G. Kaminski

It is certified that error appears in the above-identified patent and that said Letters Patent is hereby corrected as shown below:

Claim 1, Column 6, line 10, delete "injection" and insert therefor -- injecting --.

Signed and Sealed this

Twenty-fifth Day of September, 1990

*Attest:*

HARRY F. MANBECK, JR.

*Attesting Officer*

*Commissioner of Patents and Trademarks*